US005152344A

United States Patent [19]

Fischer et al.

[11] Patent Number: 5,152,344

[45] Date of Patent: Oct. 6, 1992

[54] FIRE PROTECTION SPRINKLER

[75] Inventors: Michael A. Fischer, W. Kingston; Donald B. Pounder, No. Kingstown; James W. Mears, Warwick, all of R.I.

[73] Assignee: Grinnell Corporation, Exeter, N.H.

[21] Appl. No.: 674,694

[22] Filed: Mar. 25, 1991

[51] Int. Cl.[5] ..... A62C 37/14; A62C 37/11; A62C 37/08

[52] U.S. Cl. ..... 169/37; 169/38

[58] Field of Search ..... 169/37, 39, 38, 40, 169/41, 90

[56] References Cited

U.S. PATENT DOCUMENTS

| | | | |
|---|---|---|---|
| 2,558,450 | 6/1951 | Martin | 169/37 |
| 4,014,388 | 3/1977 | Anderson | 169/37 |
| 4,066,129 | 1/1978 | Anderson | 169/37 |
| 4,880,063 | 11/1989 | Leininger et al. | 169/37 |
| 4,976,320 | 12/1990 | Polan | 169/37 X |

*Primary Examiner*—Margaret A. Focarino
*Assistant Examiner*—James M. Kannofsky
*Attorney, Agent, or Firm*—Fish & Richardson

[57] ABSTRACT

A fire protection sprinkler including a frame having an outlet opening for fire extinguishing fluid and spaced apart frame arms extending from the outlet opening to provide a support at a location spaced from the outlet opening, a sealing member covering the opening, a thermally responsive member connected between the sealing member and the support to seal off the opening during normal temperature conditions and to release the sealing member during abnormally high temperature conditions, an adapter member attached to the frame, one or more pins that are supported by the adapter member, and a deflector that is slidably mounted with respect to the adapter member via the pin or pins. Also disclosed is a clip that retains the deflector in the retracted position in a releasable fashion.

26 Claims, 4 Drawing Sheets

FIRE PROTECTION SPRINKLER

BACKGROUND OF THE INVENTION

The invention relates to concealed fire protection sprinklers having movable deflectors.

Fire protection sprinklers employ deflectors to spread out fire extinguishing fluid to cover a desired area. Some types of fire protection sprinklers employ movable deflectors that are in a retracted position when the sprinkler is inactive and in an extended position when the sprinkler is discharging fire extinguishing fluid.

Such movable deflectors are employed in concealed sprinklers that have covers that are installed flush with the ceiling mounting surface and which extend when the thermally responsive element of the sprinkler is exposed to a predetermined, elevated temperature. The deflector is in a retracted position above the lower surface of the ceiling when inactive and in a lowered position near or below the ceiling when active so as to spread the fluid out over a desired area in the room below, during a fire.

Anderson U.S. Pat. Nos. 4,014,388 and 4,066,129 describe concealed sprinklers with drop down deflectors that are supported by pins that slide within holes passing through arms of sprinkler frames, the pins extending upward into the space between the frame arms when in the inactive position. Leininger et al. U.S. Pat. No. 4,880,063 describes a concealed sprinkler with a drop down deflector that is supported by pins that slide within bosses that extend to the side of and are formed integrally on arms of a sprinkler frame.

SUMMARY OF THE INVENTION

In one aspect, the invention features, in general, a sprinkler that employs a movable deflector that is slidably mounted via one or more pins for movement between inactive and active positions on an adapter member that in turn is attached to and located outside the frame of the sprinkler. The use of an adapter member permits one to use standard sprinkler parts for the remainder of the sprinkler, and thus avoids the need to design a special frame and do extra machining to the frame arms to provide holes and/or space to accommodate the slide pin or pins into the design.

In preferred embodiments the adapter member is elongated, is attached at a central location to the bottom of the frame directly under the outlet opening of the sprinkler, and has arms that are directly under and extend beyond the arms of the frame. The pins are located outside of the frame arms. The adapter member arms are in close proximity to the bottom surfaces of the arms of the frame (e.g., less than ¼" away and preferably less than 1/16" away). The lower surfaces of the frame arms have portions that are at angles to and extend away from the horizontal, and the upper surfaces of the adapter member arms have portions that are similarly shaped and angled (e.g., within five degrees of each other). The upper surfaces of the adapter member arms are arcuately shaped to help prevent flow detachment from the adapter member arms, and are also streamlined to help prevent flow detachment from the frame arms. The adapter member has a longer vertical dimension at portions where the pin holes pass through than at the central portion connected to the frame, and the pin holes are longer than the width of the pins (preferably greater than 1.5 times the width of the pins and most preferably greater than 2 times the width of the pins). In the preferred embodiment, the adapter member is made of sintered metal, permitting the holes to be incorporated during the sintering process, thus avoiding the need to machine holes, and has a flat bottom. The adapter member is connected to the frame by riveting or staking. The preferred application for the sprinkler is as a concealed sprinkler having a mounting cup that is connected to the frame and a temperature sensitive means such as fusible solder that secures the cover to an enclosure which, in turn, is threaded into the mounting cup when completing installation of the sprinkler. The deflector is longer along a longitudinal deflector axis that intersects and is perpendicular to longitudinal axes of the pins than along a transverse axis.

In another aspect, the invention features, in general, a fire protection sprinkler having a movable deflector that is slidably mounted with respect to the frame and a clip that retains the deflector and thus protects it from damage during shipping and initial installation of the sprinkler, e.g., prior to finishing of the ceiling.

In preferred embodiments the sprinkler has a mounting cup that is connected to the frame and has an end adapted to be threadably connected to an enclosure, and the clip is attached to the mounting cup in a manner that prevents attachment of the enclosure to the cup while the clip is still in place; this guarantees that the clip will not be inadvertently left in place where it might inhibit operation of the sprinkler after the enclosure has been attached. The frame is mounted with the outlet opening directed downward. After removal of the clip, a cover plate is connected to the mounting cup via an enclosure. The clip has a U-shaped portion that engages the bottom edge of the mounting cup. The clip also has an inclined surface that releases the deflector as the deflector is biased to move from its retracted position toward its active position, e.g., by the force of fire extinguishing fluid flowing from the outlet, thus permitting operation of the sprinkler, due to abnormal heat such as caused by fire, after preliminary installation of the sprinkler but before installation of the subassembly consisting of the enclosure and cover. Another feature of this invention involves the retention of the deflector in its retracted position by the cover plate. When the cover plate drops in response to an abnormally high temperature condition, the deflector also drops. Because the deflector moves away from the thermally responsive element which seals the fluid opening, the flow of heated air around the thermally responsive element is increased, and more rapid sprinkler actuation is achieved. A further advantage of this invention is achieved by designing the deflector such that, even if the deflector does not drop below the position in which it rests against the cover, the flow distribution provided by the deflector is not significantly affected. To take full advantage of this feature, the outside area of the deflector is formed with a generally downward shape, and the enclosure has a large enough diameter to ensure that it does not significantly affect the flow of water distributed off of the deflector. When the deflector rests against the cover plate, some heat from the cover plate can be conducted into the deflector as the cover plate heats up. This could slightly retard cover plate actuation time in response to an abnormally high temperature condition. However, this effect is made relatively insignificant by minimizing the contact area between the cover plate and deflector. In the preferred embodiment, the two surfaces contact only at the lower ends of the pins. Further retardation of heat transfer can be achieved by attaching a thin, thermally insulating member, such as paper, between the deflector and the cover plate.

Other advantages and features of the invention will be apparent from the claims and the following description of the preferred embodiment thereof.

DESCRIPTION OF THE PREFERRED EMBODIMENT

The preferred embodiment will now be described.

DRAWINGS

STRUCTURE, MANUFACTURE, AND USE

Figure 1:
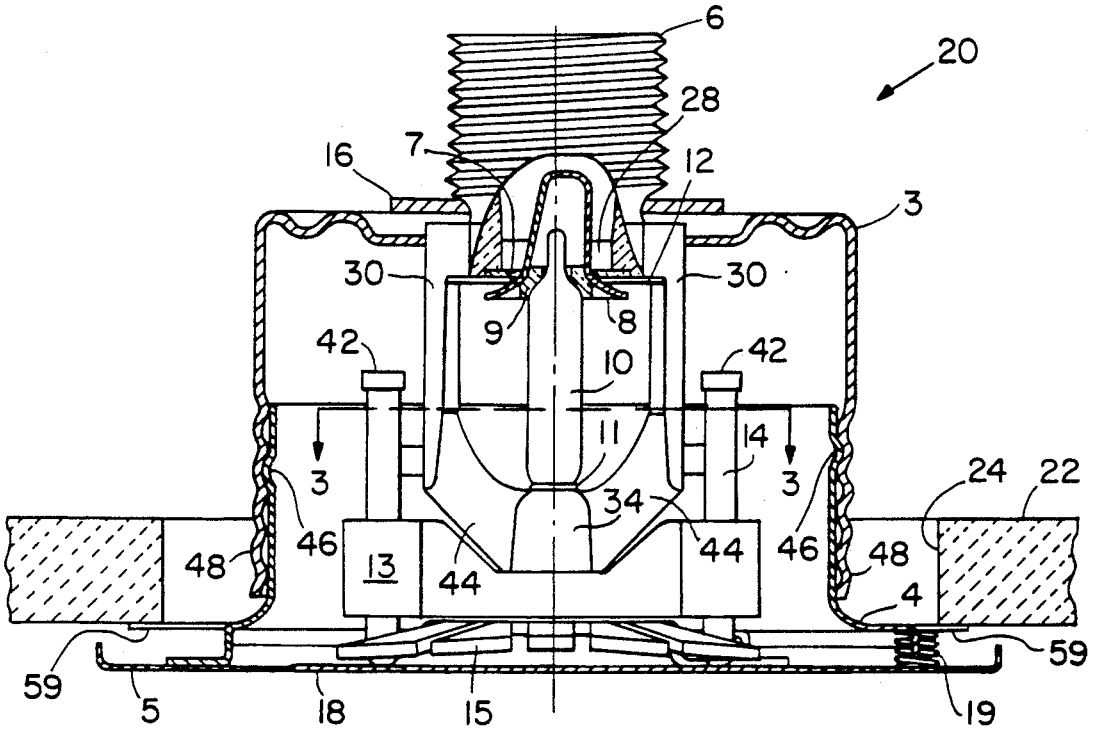
FIG. 1 is a vertical sectional view, partially broken away, of a fire protection sprinkler according to the invention shown mounted in a ceiling section.
Figure 2:
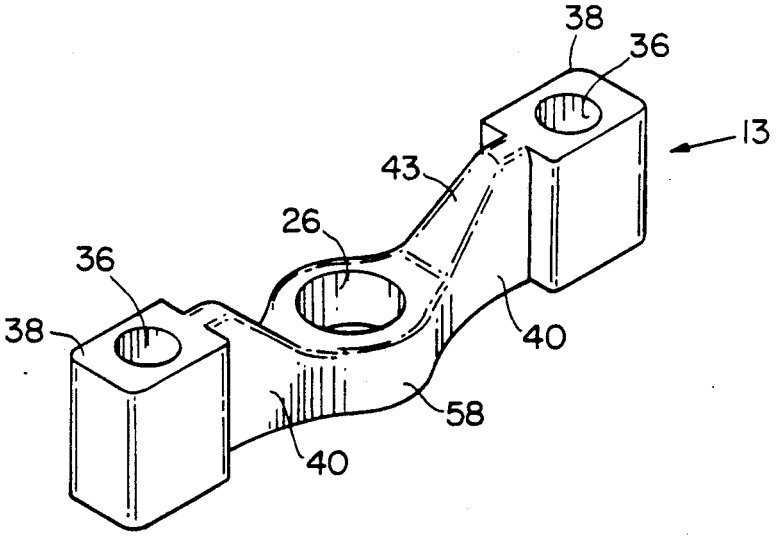
FIG. 2 is a perspective view of an adapter member of the FIG. 1 sprinkler.
Figure 3:
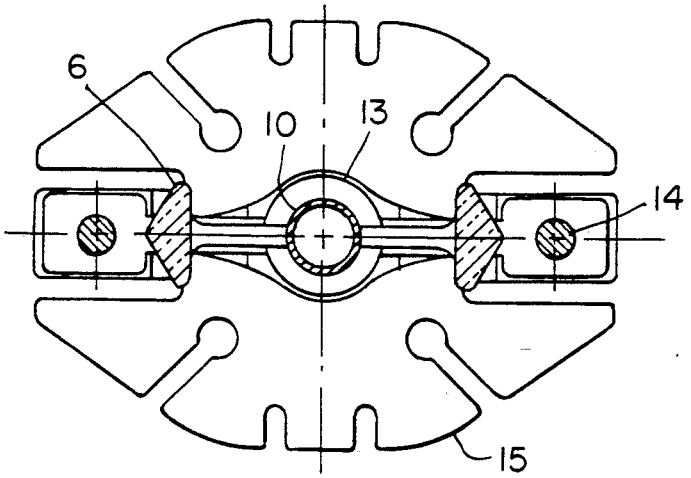
FIG. 3 is a horizontal sectional view, taken at 3—3 of FIG. 1, of some components of the FIG. 1 sprinkler.
Figure 4:
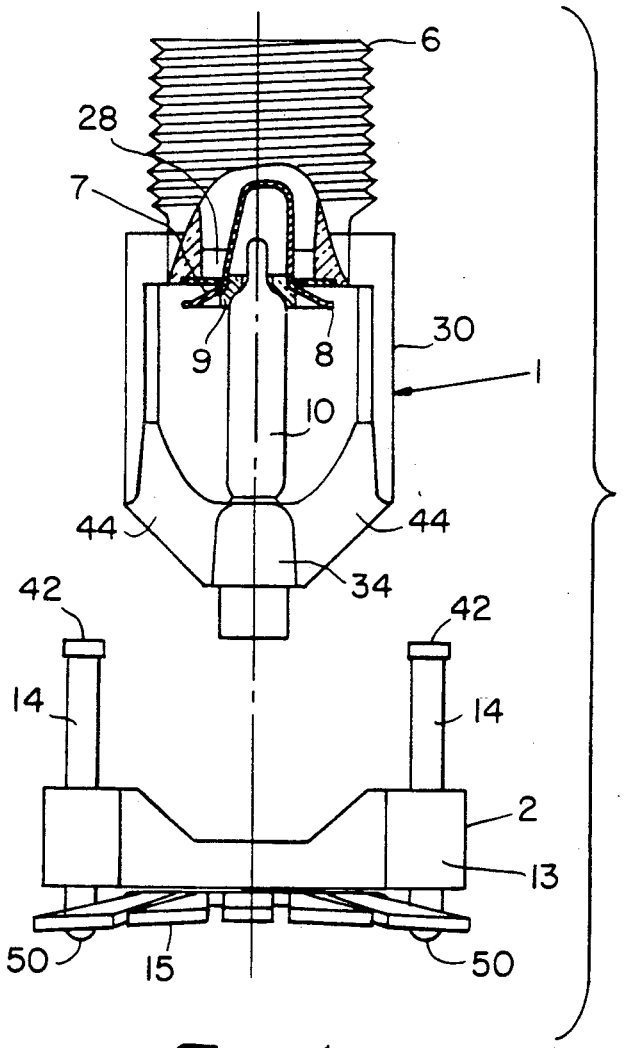
FIG. 4 is an exploded elevation, partially broken away, of subassemblies of the FIG. 1 sprinkler.
Figure 5:
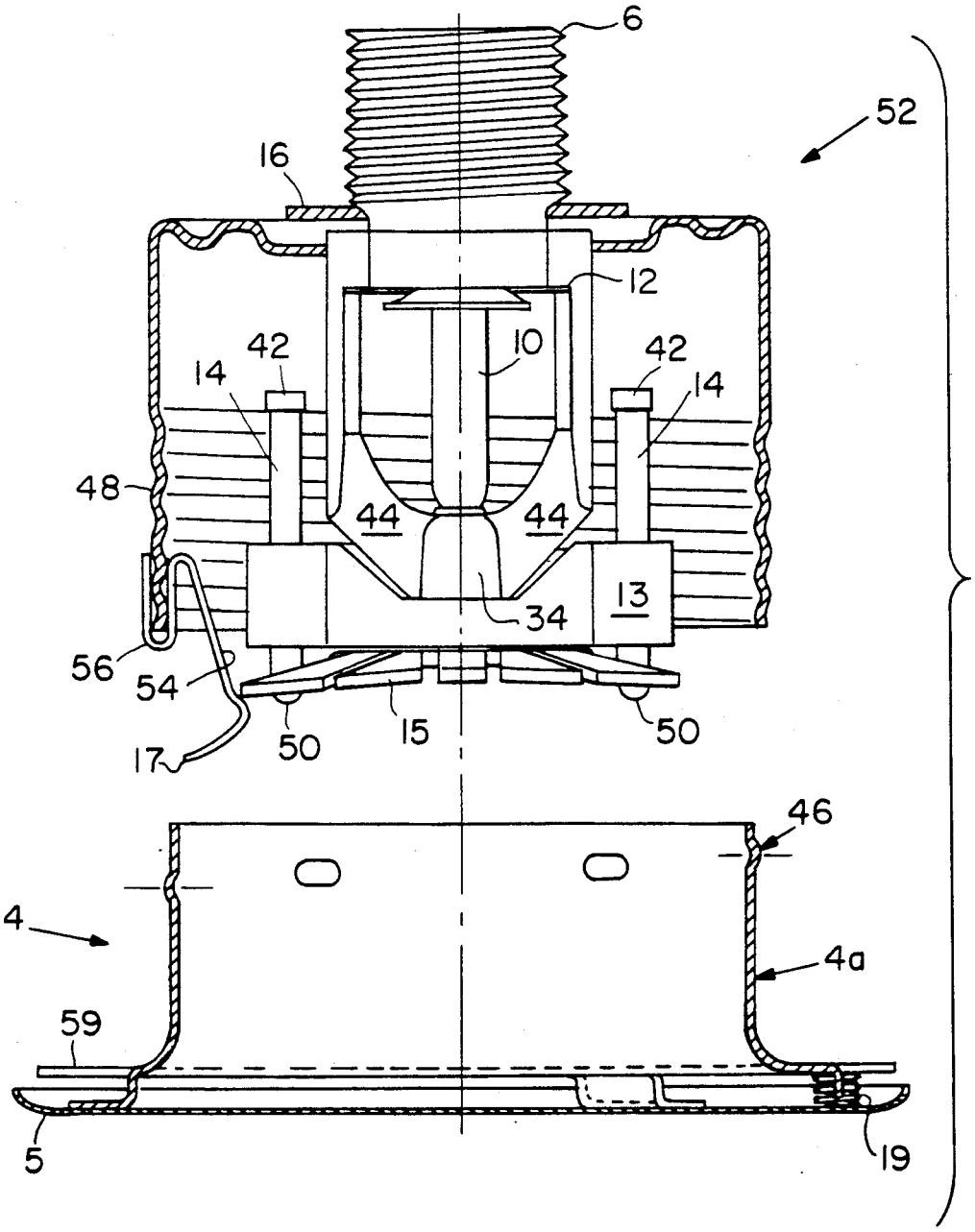
FIG. 5 is a vertical sectional view of the FIG. 1 sprinkler of an enclosure subassembly prior to installation of the latter.

Referring to the figures, and in particular to FIG. 1, fire protection sprinkler 20 is shown mounted above ceiling section 22 and extending through opening 24 through ceiling section 22. Sprinkler 20 includes a sprinkler subassembly 1 (FIG. 4), drop-down deflector subassembly 2 (FIG. 4), mounting cup 3, and enclosure subassembly 4 (FIG. 5).

Sprinkler subassembly 1 is made of standard sprinkler parts, namely frame 6, spring plate 7, button 8, insert 9, thermally responsive element 10, and loading screw 11. These parts are the same as those in a sprinkler commercially available from Grinnell Corp., Exeter, N.H. under the Designer Series trade designation. Frame 6 has outlet opening 28 for discharge of fire extinguishing fluid and spaced frame arms 30 extending down from outlet opening 28 to provide a support for loading screw 11 at a location spaced from outlet opening 28. Spring plate 7 and button 8 cover opening 28 and are supported by thermally responsive element 10 to seal off opening 28 during normal temperature conditions and to release them during abnormally high temperature conditions. Loading screw 11 is threaded upward in a threaded passage through frame boss 34 and loads element 10 from the bottom.

Figure 6:
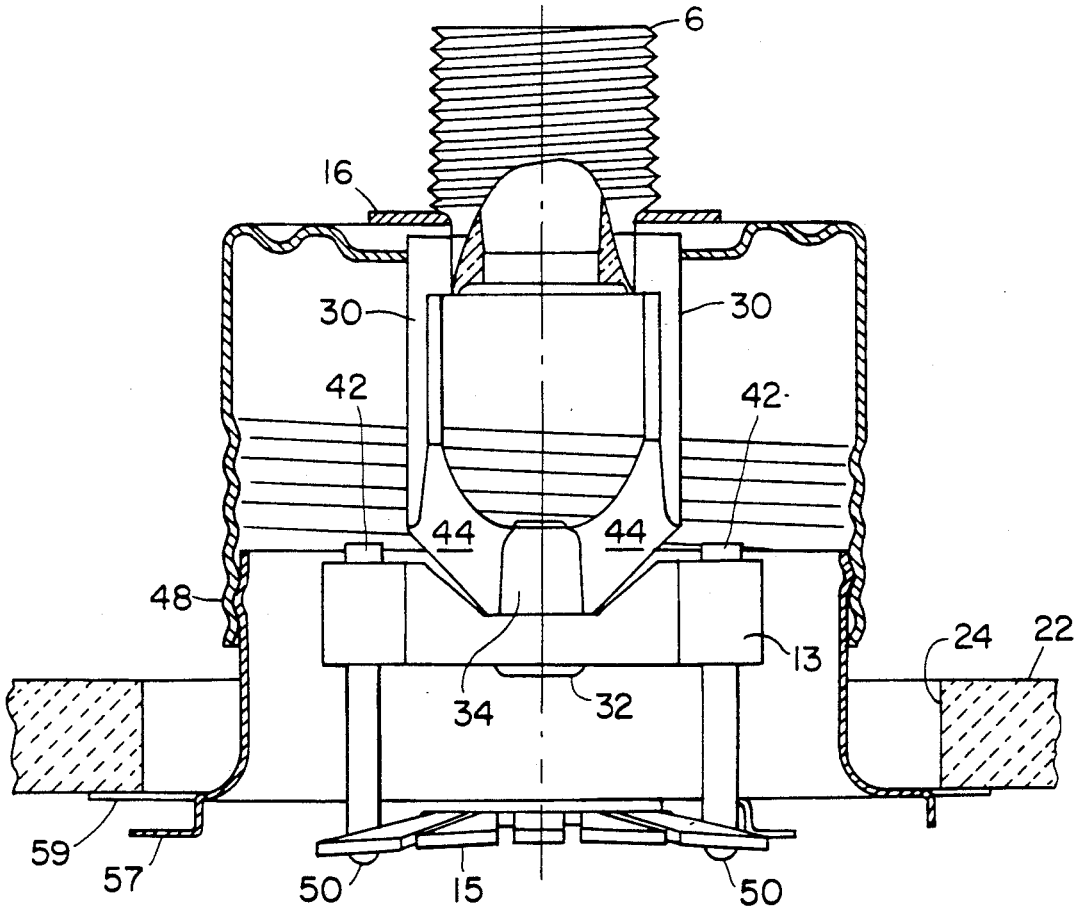
FIG. 6 is a vertical sectional view of the FIG. 1 sprinkler with the cover removed and the deflector in an active position.

Drop-down deflector subassembly 2 includes adapter member 13, pins 14, and deflector 15. Deflector 15 is made of stamped brass and has a shape designed to provide the desired flow distribution for fire extinguishing fluid. Adapter member 13 is attached at its middle by rolled over portion 32 (FIG. 6) of frame boss 34, which extends through hole 26. Adapter member 13 has two holes 36 at end blocks 38 of adapter arms 40. Adapter member 13 is made of sintered metal (brass or other high strength metal such as stainless steel), including integrally formed holes 36, avoiding the need to have an additional manufacturing step to provide the holes. Pins 14 slide within holes 36, are secured at their lower ends 50 to deflector 15, and have enlarged heads 42 at their upper ends. Pins 14 have a 0.125 ±0.002" outer diameter, and holes 36 have a 0.140±0.0015" inner diameter and are 0.375" long (the same dimension as the height of end blocks 38). These dimensions permit pins 14 and deflector 15 to freely slide owing to gravity when released but to be sufficiently firmly held when in the dropped position during discharge of fluid so as to not hinder the ability of deflector 15 to distribute water. The length of the holes should be generally greater than 1.5 times their diameter and preferably greater than 2.0 times their diameter to provide sufficiently firm support for the deflector when dropped.

The upper surfaces 43 of adapter arms 40 have curved edges, and are in close proximity to (e.g., about 1/32" away from) lower surfaces 44 of the frame arms 30. This acts to reduce disruptions of the flow stream on both frame arms 30 and adapter arms 40, permitting frame arms 30 and adapter arms 40 to act hydraulically as a single surface, as described below. Adapter arms 40 are about 0.100" wide where they connect to end blocks 38 and gradually increase in width as they get closer to the central portion. The edges of the upper surfaces have about 0.040" radii. Upper surfaces 43 are angled at about the same angle as the lower surfaces 44 of frame arms 30; lower surfaces 44 in fact make about a 45 degree angle with the horizontal, and upper surfaces 43 make a slightly smaller angle of about 43 degrees with the horizontal in order to accommodate tolerances associated with frame arms 30.

Mounting cup 3 is retained against frame 6 by E-ring 16. Enclosure **4*a* has protuberances 46 that engage threads 48 at the bottom of mounting cup 3, and cover plate 5 is secured to flange 57 of enclosure 4*a* via temperature sensitive fusible solder, not shown, that melts at 135 or 165 degrees F, depending on the operating temperature of the enclosure and cover plate. Spring 19 biases cover plate 5 downward. Enclosure 4*a* with soldered cover plate 5 and spring 19 form an enclosure subassembly 4 (FIG. 5**).

In manufacture, sprinkler subassembly 1 and deflector subassembly 2 can be separately assembled (FIG. 4) and then attached to each other by staking the central portion 58 of the adapter member to the portion of the frame boss which engages adapter hole 26. Alternatively, adapter member 13 can be attached by riveting the portion of the frame boss 34 which extends below the bottom of adapter member 13, so as to provide rolled over portion 32, prior to adding deflector 15; pins 14 would then be inserted through holes 36 and holes in deflector 15, and lower ends 50 of pins 14 would be rolled or crimped over adjacent portions of deflector 15 to secure deflector 15 to pins 14. Mounting cup 3 is then added to the threaded upper end of frame 6 and retained in place using E-ring 16. Clip 17 (made of a strip of spring temper sheet metal) is added to retain deflector 15 in the retracted position, resulting in preliminary assembly 52 shown in FIG. 5.

In installation, the upper threaded end of frame 6 of preliminary assembly 52 is threaded into a threaded fitting of pipes of a water sprinkler system that have been installed near the structural ceiling of a room. Clip !7 retains the deflector during storage, shipping and preliminary installation.

Clip 17 has inclined surface 54 on which deflector 15 rests. In the event of a fire after preliminary installation but before the removal of clip 17, clip 17 would be bent back by the action of downward fluid force on deflector 15, permitting deflector 15 to drop to the active position shown in FIG. 6. Clip 17 also has U-shaped end 56 that engages threads 48, preventing attachment of the enclosure subassembly while clip 17 is still in place.

After clip 17 has been removed, enclosure subassembly 60 (FIG. 5) is added by screwing enclosure 4 into the helical threads of mounting cup 3 until portions 59 of enclosure 4 contact ceiling section 22. Deflector 15 is maintained in its retracted position by cover plate 5. Because contact between deflector 15 and cover plate 5 is limited to the small areas of the bottoms 50 of pins 14, there is little conduction of heat from cover plate 5, which conduction might otherwise delay the dropping of cover plate 5 in response to an abnormally high temperature condition. When an abnormally high temperature condition does exist, cover plate 5 and deflector 15 drop. Because deflector 15 moves away from thermally responsive element 10, the flow of heated air around the thermally responsive element 10 is increased, and rapid sprinkler actuation is achieved. If for some reason deflector 15 does not drop when cover plate 5 drops, the flow distribution provided by the deflector is not significantly affected because the outside area of deflector 15 has a downward shape, and enclosure 4 has a large enough diameter to ensure that it does not significantly affect the flow of water off of deflector 15.

OTHER EMBODIMENTS

Other embodiments of the invention are within the scope of the following claims.

For example, instead of enclosure 4*a*, cover plate 5 could be connected to mounting cup 3 by an extension that is not continuous but instead has two or more arms.

What is claimed is:

1. A fire protection sprinkler comprising
a frame having an outlet opening for fire extinguishing fluid and spaced apart frame arms extending from the outlet opening to provide a support at a location spaced from the outlet opening,
a sealing member covering the opening,
a thermally responsive member connected between the sealing member and the support to seal off the opening during normal temperature conditions and to release said sealing member during abnormally high temperature conditions,
an adapter member attached to said frame downstream of said frame from said outlet opening,
a pin that is supported by said adapter member, and
a deflector that is slidably mounted with respect to said adapter member via said pin,
wherein said adapter member is elongated, is attached at a central portion thereof to a portion of the frame directly in line with the flow of fluid from the outlet opening of the sprinkler, and has adapter arms that are downstream of said frame arms, and wherein said pin is supported by one of said adapter arms, and further comprising a second pin supported by another of said adapter arms, and wherein said deflector is slidably mounted with respect to said adapter m ember via said second pin.

2. The sprinkler of claim 1 wherein said sprinkler member is adapted to be mounted with said outlet opening directed downward, and said adapter member is located under said frame.

3. The sprinkler of claim 1 wherein said adapter member is made of sintered metal.

4. The sprinkler of claim 1 wherein said adapter member is riveted to said frame.

5. The sprinkler of claim 1 wherein said adapter arms have upstream surfaces that are arcuate in cross section so as to minimize flow detachment therefrom.

6. The sprinkler of claim 5 wherein said adapter surfaces are sufficiently streamlined so as to minimize flow detachment from said frame arms.

7. The sprinkler of claim 1 further comprising a cover plate that is connected to said frame by temperature sensitive releasable means.

8. The sprinkler of claim 7 wherein said temperature sensitive releasable means includes a mounting cup that is connected to said frame, an extension unit is connected to said mounting cup, and a temperature sensitive fusible solder that connects said cover plate to said extension.

9. The sprinkler of claim 8 wherein said extension is an enclosure that is connected to said mounting cup via helical threads.

10. The sprinkler of claim 7 wherein the deflector rests on the cover plate.

11. The sprinkler of claim 10 wherein the deflector is shaped such that fluid flowing from the outlet opening does not substantially contact any surfaces of the temperature sensitive releasable means which attaches the cover plate to the frame even when the deflector is retained at the position which it occupies when resting against the cover plate.

12. The sprinkler of claim 1 wherein said adapter arms are directly downstream of and extend beyond said frame arms, and said adapter member has holes through which respective said pins pass, said pins being located radially outside of said frame arms.

13. The sprinkler of claim 12 wherein said deflector is longer along a longitudinal deflector axis that intersects and is perpendicular to longitudinal axes of said pins than along a transverse axis.

14. The sprinkler of claim 12 wherein said adapter member has a longer dimension in the direction of fluid flow at portions where said holes pass through said arms than at said central portion connected to said frame, said pins have a width, and said holes are longer than the width of the pins.

15. The sprinkler of claim 14 wherein said holes are longer than one and one-half times the width of said pins.

16. The sprinkler of claim 14 wherein said holes are longer than twice the width of said pins.

17. The sprinkler of claim 12 wherein said frame arms have downstream surfaces, and said adapter arms have upstream surfaces that are less than ¼" away from said downstream surfaces.

18. The sprinkler of claim 17 wherein said upstream surfaces are less than 1/16" away from said downstream surfaces.

19. The sprinkler of claim 17 wherein said downstream surfaces of said frame arms have portions that are at acute angles to an axis along the direction of fluid flow out of said outlet opening, and said upstream surfaces of said adapter arms have corresponding portions that have angles with said axis that are within five degrees of angles of said downstream surfaces.

20. The sprinkler of claim 19 wherein said adapter member is made of sintered metal and has a downstream surface that is essentially flat.

21. A fire protection sprinkler comprising a frame having an outlet opening for fire extinguishing fluid and spaced apart frame arms extending from the outlet opening to provide a support at a location spaced from the outlet opening, a sealing member covering the opening, a thermally responsive member connected between the sealing member and the support to seal off the opening during normal temperature conditions and to release said sealing member during abnormally high temperature conditions, a deflector that is slidably mounted with respect to said frame from a retracted position close to said frame and an active position further away from said frame than said retracted position, and a clip that is releasably connected to said frame and retains said deflector, preventing movement of said deflector with respect to said frame during normal temperature conditions, further comprising a mounting cup that is connected to said frame and has an end adapted to be connected to a cover plate via an extension, and wherein said clip is positioned so as to prevent attachment of said extension to said mounting cup while said clip is still in place.

22. The sprinkler of claim 21 wherein said clip has a U-shaped portion that engages the mounting cup at said end.

23. The sprinkler of claim 21 wherein said frame is adapted to be mounted with said outlet opening directed downward.

24. The sprinkler of claim 23 wherein said extension is an enclosure, the connection of the mounting cup to the enclosure adjustably controlling the distance from the cover plate to the frame.

25. The sprinkler of claim 24 wherein said mounting cup is connected to said enclosure via helical threads.

26. A fire protection sprinkler comprising a frame having an outlet opening for fire extinguishing fluid and spaced apart frame arms extending from the outlet opening to provide a support at a location spaced from the outlet opening, a sealing member covering the opening, a thermally responsive member connected between the sealing member and the support to seal off the opening during normal temperature conditions and to release said sealing member during abnormally high temperature conditions, a deflector that is slidably mounted with respect to said frame from a retracted position close to said frame and an active position further away from said frame than said retracted position, and a clip that is releasably connected to said frame and retains said deflector, preventing movement of said deflector with respect to said frame during normal temperature conditions, wherein said clip contacts said deflector at a surface of said clip that is inclined so as to release said deflector as said deflector is biased to move from said retracted position toward said active position due to the flow of fire extinguishing fluid from said outlet opening.

* * * * *